US009246222B2

(12) United States Patent
Fasenfest

(10) Patent No.: US 9,246,222 B2
(45) Date of Patent: Jan. 26, 2016

(54) COMPACT WIDEBAND PATCH ANTENNA

(71) Applicant: Tyco Electronics Corporation, Berwyn, PA (US)

(72) Inventor: Kathleen Fasenfest, Union City, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 213 days.

(21) Appl. No.: 13/841,954

(22) Filed: Mar. 15, 2013

(65) Prior Publication Data

US 2014/0266963 A1 Sep. 18, 2014

(51) Int. Cl.
*H01Q 1/38* (2006.01)
*H01Q 9/04* (2006.01)

(52) U.S. Cl.
CPC ..... *H01Q 9/045* (2013.01)

(58) Field of Classification Search
CPC ..... H01Q 9/45
USPC ..... 343/700 MS, 829, 846
See application file for complete search history.

(56) References Cited

U.S. PATENT DOCUMENTS

| | | | | |
|---|---|---|---|---|
| 4,973,972 | A * | 11/1990 | Huang | 343/700 MS |
| 6,342,856 | B1 | 1/2002 | Nakano et al. | |
| 6,597,316 | B2 * | 7/2003 | Rao et al. | 343/700 MS |
| 6,700,539 | B2 * | 3/2004 | Lim | 343/700 MS |
| 7,209,080 | B2 * | 4/2007 | Crouch et al. | 343/700 MS |
| 2002/0036590 | A1 | 3/2002 | Itoh et al. | |
| 2004/0004571 | A1 | 1/2004 | Adachi et al. | |
| 2006/0007044 | A1 | 1/2006 | Crouch et al. | |
| 2006/0044191 | A1 | 3/2006 | Harihara | |
| 2008/0042915 | A1 | 2/2008 | Schillmeier et al. | |
| 2009/0046026 | A1 | 2/2009 | Nakano et al. | |
| 2009/0102723 | A1 * | 4/2009 | Mateychuk et al. | 343/700 MS |
| 2009/0256773 | A1 | 10/2009 | Lindmark | |
| 2014/0266963 | A1 | 9/2014 | Fasenfest | |

OTHER PUBLICATIONS

International Search Report of International Application No. PCT/US2014/011745, Jul. 11, 2014.

* cited by examiner

*Primary Examiner* — Tho G Phan

(57) ABSTRACT

A patch antenna includes a dielectric substrate having a body that extends a thickness from a first side to a second side that is opposite the first side. The body of the substrate includes thru openings that extend through the thickness of the body. A radiating patch is positioned on the first side of the body of the substrate. The radiating patch includes holes that are aligned with corresponding thru openings of the body of the substrate. A ground plane is positioned on the second side of the body of the substrate. At least three feed probes are electromagnetically coupled to the radiating patch such that the patch antenna is configured to generate a circularly polarized radiation pattern. Each feed probe includes a conductive path that extends within a corresponding thru opening of the body of the substrate from the second side of the body to the first side of the body. Each conductive path being exposed along the first side of the body via the holes of the radiating patch. The feed probes are positioned relative to the body of the substrate such that adjacent feed probes are spaced apart from each other along the body. The feed probes are configured to feed the radiating patch at at least three points with approximately equal power amplitude.

17 Claims, 10 Drawing Sheets

COMPACT WIDEBAND PATCH ANTENNA

BACKGROUND OF THE INVENTION

The subject matter disclosed herein relates generally to antennas, and more particularly to patch antennas.

Satellite navigation systems are well known for providing autonomous geo-spatial positioning. Satellite navigation systems typically include a constellation of satellites that orbit the earth. The constellation of satellites enables an electronic receiver to determine its location (e.g., longitude, latitude, and altitude) using signals that are transmitted by radio frequency (RF) waves from the orbiting satellites. Satellite navigation systems with global coverage are commonly referred to as global navigation satellite systems (GNSSs). Although GNSSs have global coverage, different GNSSs may serve different regions. For example, different GNSSs may serve the United States, Europe, and Russia. Each different GNSS includes its own constellation of satellites that operates within its own frequency bands. In other words, different GNSSs that serve different regions may operate within different frequency bands.

Patch antennas are commonly used with electronic receivers for communicating with GNSS satellite constellations. A patch antenna is a type of antenna that typically includes a flat sheet, or patch, of metal that is mounted over a ground plane. Known patch antennas are not without disadvantages. For example, the frequency band of at least some known patch antennas may be too narrow to enable the patch antenna to communicate with one or more of the different GNSS satellite constellations. Specifically, at least some known patch antennas operate over a relatively narrow frequency band that does not overlap the frequency band of one or more of the different GNSS satellite constellations. The patch antenna therefore cannot communicate with such a GNSS satellite constellation because the patch antenna does not operate within the frequency band of the GNSS satellite constellation. For example, the frequency band of a patch antenna may overlap, or fall entirely within, the frequency band of a first GNSS satellite constellation that serves a region. But, the frequency band of the patch antenna may be too narrow to overlap the frequency band of a second GNSS satellite constellation that serves a different region. Accordingly, the patch antenna is capable of communicating with the first GNSS satellite constellation but is not capable of communicating with the second GNSS satellite constellation. The frequency band of at least some known patch antennas may be so narrow that the patch antenna is limited to communicating with a particular GNSS satellite constellation using only portion (i.e., a subband) of the frequency band of the GNSS satellite.

Another disadvantage of at least some known patch antennas is their size. For example, a single electronic receiver may be associated with a plurality of patch antennas that are grouped together in an array. But, there may be a limited amount of space for containing the array of patch antennas, which may limit the number of patch antennas that can be included within the array. For example, the width and/or a similar dimension (e.g., diameter and/or the like) of at least some known patch antennas limits the number of patch antennas that can be arranged side-by-side in the available space.

BRIEF DESCRIPTION OF THE INVENTION

In one embodiment, a patch antenna includes a dielectric substrate having a body that extends a thickness from a first side to a second side that is opposite the first side. The body of the substrate includes thru openings that extend through the thickness of the body. The patch antenna also includes a radiating patch positioned on the first side of the body of the substrate. The radiating patch includes holes that are aligned with corresponding thru openings of the body of the substrate. A ground plane is positioned on the second side of the body of the substrate. At least three feed probes are electromagnetically coupled to the radiating patch such that the patch antenna is configured to generate a circularly polarized radiation pattern. Each feed probe includes a conductive path that extends within a corresponding thru opening of the body of the substrate from the second side of the body to the first side of the body. Each conductive path is exposed along the first side of the body via the holes of the radiating patch. The feed probes are positioned relative to the body of the substrate such that adjacent feed probes are spaced apart from each other along the body. The feed probes are configured to feed the radiating patch at at least three points with approximately equal power amplitude.

In another embodiment, a patch antenna includes at least first and second dielectric substrates each having a body that extends a thickness from a first side to a second side that is opposite the first side. The body of each of the at least first and second substrates includes openings that extend along the thickness of the body. A ground plane is positioned on the second side of the body of the first substrate. A first radiating patch is positioned on the first side of the body of the first substrate. The body of the second substrate is positioned on the first radiating patch such that the second side of the body of the second substrate faces the first radiating patch. The first radiating patch includes first holes that are aligned with corresponding openings of the body of the first substrate. A second radiating patch is positioned on the first side of the body of the second substrate. The second radiating patch includes second holes that are aligned with corresponding openings of the body of the second substrate. The patch antenna includes at least three feed probes that are electromagnetically coupled to the first and second radiating patches such that the antenna is configured to generate a circularly polarized radiation pattern. Each feed probe includes a conductive path that extends within a corresponding opening of the body of at least one of the first or second substrates. The feed probes are configured to feed the first and second radiating patches at at least three points with approximately equal power amplitude.

In another embodiment, a patch antenna includes at least first, second, and third dielectric substrates each having a body that extends a thickness from a first side to a second side that is opposite the first side. The body of at least the first and second substrates of the at least first, second, and third substrates includes openings that extend through the thickness of the body. A ground plane is positioned on the second side of the body of the first substrate. A first radiating patch is positioned on the first side of the body of the first substrate. The body of the second substrate is positioned on the first radiating patch such that the second side of the body of the second substrate faces the first radiating patch. The first radiating patch includes first holes that are aligned with corresponding openings of the body of the first substrate. A second radiating patch is positioned on the first side of the body of the second substrate. The body of the third substrate is positioned on the second radiating patch such that the second side of the body of the third substrate faces the second radiating patch. The second radiating patch includes second holes that are aligned with corresponding openings of the body of the second substrate. The patch antenna includes at least three feed probes that are electromagnetically coupled to the first and second radiating patches such that the antenna is configured to generate a circularly polarized radiation pattern. Each feed probe includes a conductive path that extends within a corresponding opening of the body of at least one of the first, second, or third substrates. The feed probes are configured to feed the first and second radiating patches at at least three points with approximately equal power amplitude.

DETAILED DESCRIPTION OF THE INVENTION

Figure 1:
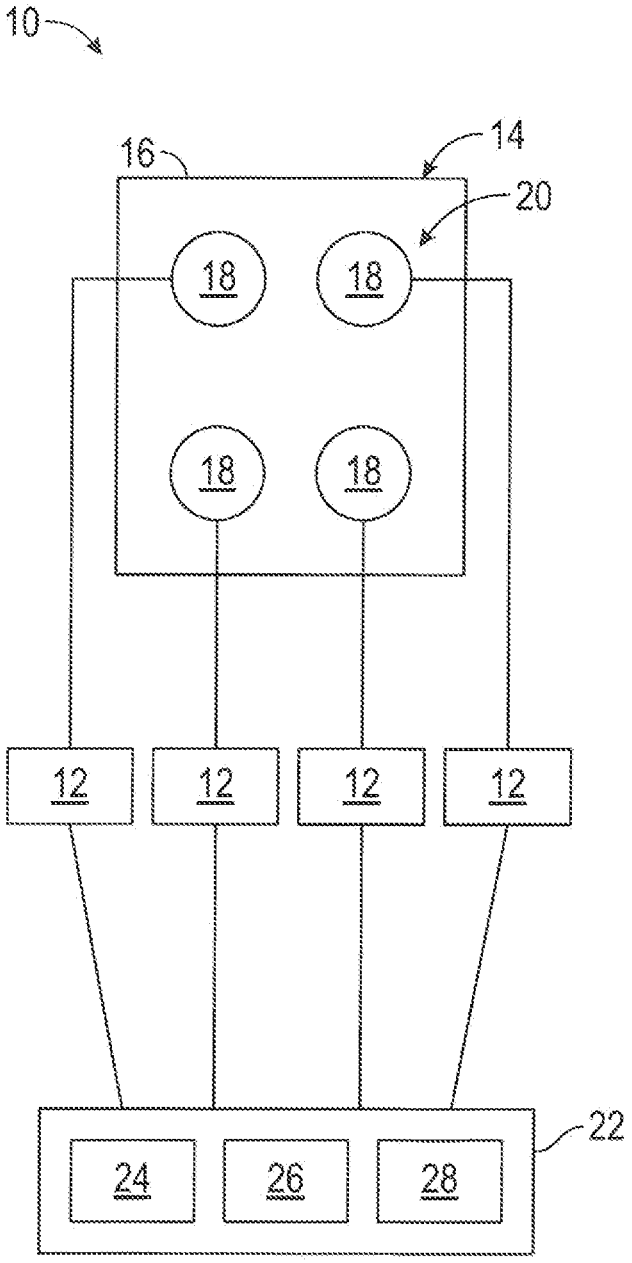
FIG. 1 is a schematic diagram of an exemplary embodiment of an antenna system.

FIG. 1 is a schematic diagram of an exemplary embodiment of an antenna system 10. The antenna system 10 includes a plurality of feed networks 12 and an antenna assembly 14. The antenna assembly 14 includes a ground plane 16 and one or more patch antennas 18 positioned on the ground plane 16. In the exemplary embodiment of the antenna system 10, the antenna assembly 14 includes an array 20 of four patch antennas 18. But, the array 20 may include any number of patch antennas 18, the antenna assembly 14 may include any number of the arrays 20, and the antenna assembly 14 may include any number of patch antennas 18 overall. In some embodiments, the antenna assembly 14 includes only a single patch antenna 18. The patch antennas 18 may be arranged within the array 20 in any other pattern than is shown in FIG. 1.

The antenna system 10 may function as a transmitting antenna system that transmits RF waves into the environment (e.g., the atmosphere) of the antenna system 10, as a receiving antenna system that receives RF waves from the environment of the antenna system 10, or as a combination of a transmitting and a receiving antenna system 10. Each patch antenna 18 is operatively connected to a corresponding feed network 12 for receiving RF waves from the corresponding feed network 12 and/or for delivering RF waves to the corresponding feed network 12. As shown in FIG. 1, each feed network 12 is operatively connected to one or more processing systems 22, which may or may not be considered a component of the antenna system 10. The operative connection of the feed networks 12 between the processing system 22 and the patch antennas 18 enables the feed networks 12 to feed RF energy between the patch antennas 18 and the processing system 22. Each feed network 12 may include one or more components (not shown) for converting RF waves received by the patch antennas 18 into RF electrical signals for delivery to the processing system 22, and/or vice versa. Optionally, another electrical circuit (not shown) is operatively connected between the feed networks 12 and the processing system 22 for combining the RF electrical signals that correspond to a plurality of patch antenna 18 and feed network 12 pairs.

The processing system 22 includes one or more transmitters 24, one or more receivers 26, and/or one or more transceivers 28. The inclusion of any transmitters 24, any receivers 26, and any transceivers 28 may depend on whether the antenna system 10 functions as a transmitting antenna system, as a receiving antenna system, or as a combination of a transmitting and a receiving antenna system. The processing system 22 may include any number of the transmitters 24, any number of the receivers 26, and any number of the transceivers 28, the number of each of which may or may not correspond to the number of patch antennas 18. The processing system 22 may include other components in addition to the transmitters 24, receivers 26, and transceivers 28.

Each patch antenna 18 may function as a receiving antenna, a transmitting antenna, or as both a receiving and a transmitting antenna. In other words, each of the patch antennas 18 may transmit RF waves into the environment, may receive RF waves from the environment, or may both transmit RF waves and receive RF waves. In some embodiments, all of the patch antennas 18 are receiving antennas that do not transmit RF waves. In other embodiments, all of the patch antennas 18 are transmitting antennas that do not receive RF waves from the environment, or all of the patch antennas 18 are transceiving antennas that both transmit RF waves and receive RF waves. In still other embodiments, the antenna assembly 14 includes a combination of one or more receiving patch antennas 18 that do not transmit RF waves, one or more transmitting patch antennas 18 that do not receive RF waves, and/or one or more transceiving patch antennas 18 that both transmit and receive RF waves.

In the exemplary embodiment of the antenna assembly 14, the ground plane 16 is shown as being common to all of the patch antennas 18. In other words, all of the patch antennas 18 are positioned on the same ground plane 16. Alternatively, the antenna assembly 14 includes more than one ground plane 16, with each ground plane 16 having one or more corresponding patch antennas 18 positioned thereon. In some embodiments, each patch antenna 18 is positioned on a different ground plane 16 than each other patch antenna 18. The ground plane (s) 16 may be considered to be a component of any patch antennas 18 that are positioned thereon.

The antenna system 10 may be any type of antenna system having any application, such as, but not limited to, a controlled reception pattern antenna (CRPA), a fixed reception pattern antenna (FRPA), a global positioning system (GPS) antenna, a global navigation satellite system (GNSS) antenna, and/or the like.

Figure 2:
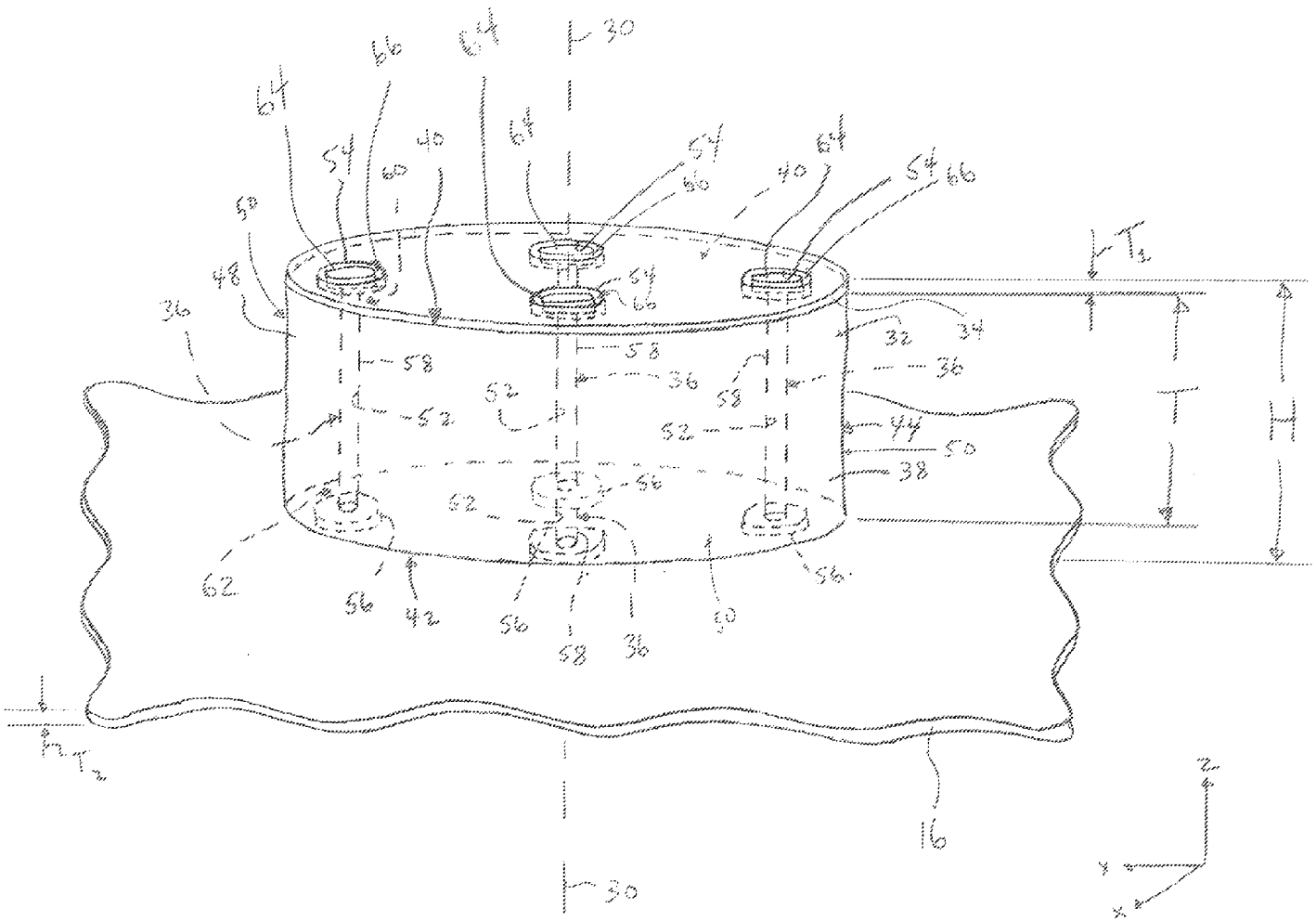
FIG. 2 is a perspective view of an exemplary embodiment of a patch antenna of the antenna system shown in FIG. 1.
Figure 3:
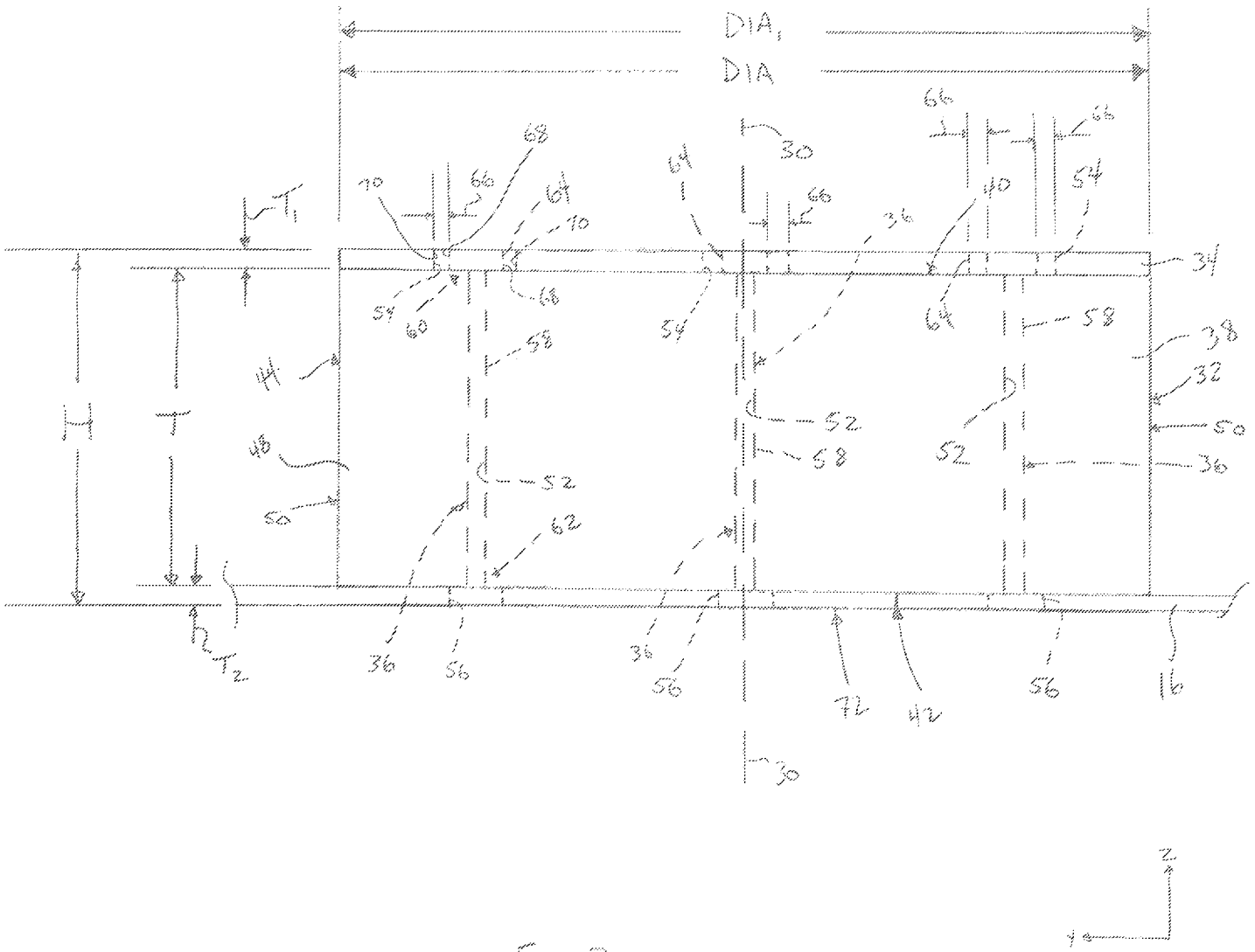
FIG. 3 is an elevational view of the patch antenna shown in FIG. 2.

FIG. 2 is a perspective view of an exemplary embodiment of one of the patch antennas 18. FIG. 3 is an elevational view of the patch antenna 18 shown in FIG. 2. Referring now to FIGS. 2 and 3, the patch antenna 18 extends a height H along a central axis 30. The patch antenna 18 includes a dielectric substrate 32, a radiating patch 34 positioned on the substrate 32, and a plurality of feed probes 36. The ground plane 16 is shown in FIGS. 2 and 3 and may or may not be considered a component of the patch antenna 18. The feed probes 36 are electrically connected to the feed network 12 (FIG. 1) for exciting (i.e., energizing) the radiating patch 34. When excited by the feed probes 36, the patch antenna 18 is resonant and thereby transmits and/or receives RF waves.

The substrate 32 of the patch antenna 18 has a body 38 that includes opposite sides 40 and 42. The substrate body 38 extends a thickness T along the central axis 30 from the side 40 to the side 42. The substrate body 38 has a diameter DIA (not labeled in FIG. 2). The substrate body 38 includes one or more side walls 44 that extend along the thickness T of the body 38 from the side 40 to the side 42. In the exemplary embodiment of the substrate 32, a cross section of the substrate body 38 taken along an x-y plane (which extends approximately perpendicular to central axis 30) has the shape of a circle. Accordingly, the substrate body 38 includes a single continuous side wall 44 in the exemplary embodiment. But, the substrate body 38 may include a greater number of side walls 44 in embodiments wherein the substrate body 38 has a different cross-sectional shape taken along the x-y plane. The side 40 of the substrate body 38 may be referred to herein as a "first" side, while the side 42 may be referred to herein as a "second" side.

The side wall 44 of the substrate body 38 has an exterior surface 48 that defines a perimeter 50 of the substrate body 38. Specifically, the perimeter 50 is a radial perimeter wherein the exterior surface 48 defines the portions of the body 38 that extend radially outermost relative to the central axis 30. It should be understood that the perimeter 50 will be defined by the exterior surfaces 48 of a plurality of side walls 44 in embodiments wherein the cross-sectional shape of substrate body 38 provides the body 38 with more than one side wall 44.

The substrate body 38 includes thru openings 52 that extend through the thickness T of the body 38. Specifically, each thru opening 52 extends through the sides 40 and 42 and completely through the body 38 between the sides 40 and 42. As will be described below, the thru openings 52 are configured to receive the feed probes 36 therein. Although shown as having a cylindrical shape (i.e., a circular cross-sectional shape), each of the thru openings 52 may include any other cross-sectional shape (whether or not the shape of the thru opening 52 is the same as the shape of the corresponding feed probe 36), such as, but not limited to, square, rectangular, oval, closed curves, shapes having more than four sides, and/or the like. Although four are shown (only three are visible in FIG. 3 due to the orientation of FIG. 3), the substrate body 38 may include any number of the thru openings 52 for receiving any number of feed probes 36.

The body 38 of the substrate 32 is a solid body. By a "solid body", it is meant that the material of at least a majority of the substrate body 38 is in the solid phase. The solid body 38 of the substrate 30 can be distinguished from a non-solid body wherein a majority of the material of the body is in gaseous and/or liquid phase. As used herein, a "solid body" may include one or more portions having material that is in the gaseous phase (e.g., air and/or the like) and/or may include one or more portions having material that is in the liquid phase (e.g., water and/or the like), for example contained within one or more internal pockets (not shown) of the solid body. In the exemplary embodiment of the substrate 32, the material of an approximate entirety of the material substrate body 38 is in the solid phase. But, as should be appreciated from above, the body 38 of the substrate 32 may alternatively include one or more pockets of a gaseous and/or a liquid material and still be considered a "solid body".

The substrate body 38 optionally has a dielectric constant that is greater than the dielectric constant of air. Specifically, air has a dielectric constant of approximately 1.001. In some embodiments, the substrate body 38 may have any dielectric constant that is greater than approximately 1.001. In some embodiments, the body 38 of the substrate 32 has a dielectric constant of greater than approximately 2.0, greater than approximately 6.0, and/or greater than approximately 10.0. In other embodiments, the substrate body 38 has a dielectric constant that is approximately equal to the dielectric constant of air. The substrate body 38 may be fabricated from any material. Examples of suitable materials for the substrate body 38 include, but are not limited to, ceramic, rubber, fluoropolymer, composite material, fiber-glass, a polymer, polystyrene, plastic, and/or the like. In one non-limiting example of the substrate body 38, the substrate body 38 is fabricated from a ceramic and has a dielectric constant of approximately 13.0.

As discussed above, a cross section of the substrate body 38 taken along an x-y plane has the shape of a circle in the exemplary embodiment of the substrate 32. But, the substrate body 38 may additionally or alternatively have any other cross-sectional shape taken along an x-y plane. Other examples of the cross-sectional shape of the substrate body 38 taken along an x-y plane include, but are not limited to, square, rectangular, oval, closed curves, triangular, trapezoidal, shapes having more than four sides, and/or the like. Moreover, although shown as being approximately constant along the thickness T, the diameter DIA of the substrate body 38 may alternatively be variable along the thickness T. In other words, the diameter DIA of the substrate body 38 may be variable within a cross section of the substrate body 38 taken along an x-z and/or a y-z plane. For example, the substrate body 38 may be tapered such that the diameter DIA gets progressively smaller or progressively larger as the thickness T extends from the ground plane 16 toward the radiating patch 34. Examples of the cross-sectional shape of the substrate 32 taken along an x-z and/or a y-z plane include, but are not limited to, trapezoidal, triangular, hourglass shapes, and/or the like.

As shown in FIG. 2, the substrate 32 of the patch antenna 18 is positioned on the ground plane 16 such that the side 42 of the substrate body 38 is engaged in physical contact with the ground plane 16. In other words, the ground plane 16 is positioned on the side 42 of the substrate body 38. The radiating patch 34 is positioned on the side 40 of the substrate body 38 that is opposite the side 42. The thickness T of the substrate body 38 thus spaces the radiating patch 34 apart from the ground plane 16. The radiating patch 34 has a diameter $DIA_1$ (not labeled in FIG. 2) and a thickness $T_1$.

The radiating patch 34 is electrically conductive and may be fabricated from any electrically conductive material, such as, but not limited to, copper, gold, silver, aluminum, tin, and/or the like. The diameter $DIA_1$ and the thickness $T_1$ of the radiating patch 34 may each have any suitable value that enables the patch antenna 18 to function as described and/or illustrated herein. Although shown as having approximately the same size as the substrate body 38 in the x and y directions, the radiating patch 34 may be larger or smaller than the substrate body 38 in the x direction and/or may be larger or smaller than the substrate body 38 in the y direction. For example, although the diameter $DIA_1$ of the radiating patch 34 is shown has having approximately the same value as the diameter DIA of the substrate body 38, the diameter $DIA_1$ of the radiating patch 34 may be greater or less than the diameter DIA of the substrate body 38. Moreover, although shown as having the same general circular cross-sectional shape as the substrate body 38 taken along an x-y plane, the radiating patch 34 may alternatively have a different cross-sectional shape than the substrate body 38 taken along an x-y plane. Other examples of the cross-sectional shape of the radiating patch 34 taken along an x-y plane include, but are not limited to, square, rectangular, oval, closed curves, triangular, trapezoidal, shapes having more than four sides, and/or the like.

The radiating patch 34 includes holes 54 that extend through the thickness $T_1$ of the radiating patch 34. As can be seen in FIGS. 2 and 3, each hole 54 of the radiating patch 34 is aligned with a corresponding thru opening 52 of the substrate body 38. Although shown as having a cylindrical shape (i.e., a circular cross-sectional shape), each of the holes 54 may include any other cross-sectional shape, such as, but not limited to, square, rectangular, oval, closed curves, shapes having more than four sides, and/or the like. In the exemplary embodiment of the radiating patch 34, the radiating patch 34 includes four holes 54, as can be seen in FIG. 2. But, the radiating patch 34 may include any number of the holes 54.

The ground plane 16 may be fabricated from any electrically conductive material, such as, but not limited to, copper, gold, silver, aluminum, tin, and/or the like. In the exemplary embodiment of the patch antenna 18, the ground plane 16 is larger than the radiating patch 34 in both the x and y directions. But, the ground plane 16 may be smaller or approximately the same size as the radiating patch 34 in the x direction and/or may be smaller or approximately the same size as the radiating patch 34 in the y direction. The ground plane 16 may have any size in the x direction and any size in the y direction relative to the radiating patch 34 that enables the patch antenna 18 to function as described and/or illustrated herein, whether or not the ground plane 16 is common to more than one patch antenna 18 of the antenna assembly 14 (FIG. 1). Although shown as having a circular cross-sectional shape taken along an x-y plane, the ground plane 16 may alternatively have a different cross-sectional shape taken along an x-y plane, such as, but not limited to, square, rectangular, oval, closed curves, triangular, trapezoidal, shapes having more than four sides, and/or the like.

The ground plane 16 has a thickness $T_2$. The ground plane 16 includes holes 56 that extend through the thickness $T_2$ of the ground plane 16. Each hole 56 of the ground plane 16 is aligned with a corresponding thru opening 52 of the substrate body 38. In the exemplary embodiment of the ground plane 16, the ground plane 16 includes four holes 56, as shown in FIG. 2. But, the ground plane 16 may include any number of the holes 56. Although shown as having a cylindrical shape (i.e., a circular cross-sectional shape), each of the holes 56 may include any other cross-sectional shape, such as, but not limited to, square, rectangular, oval, closed curves, shapes having more than four sides, and/or the like.

As described above, the feed probes 36 are electrically connected to the feed network 12 for exciting the radiating patch 34. Each feed probe 36 includes an electrically conductive path 58 that extends within a corresponding thru opening 52 of the substrate body 38 from the second side 42 of the substrate body 38 to the first side 40 of the substrate body 38. Each conductive path 58 thereby extends along an approximate entirety of the thickness T of the substrate body 38. In the exemplary embodiment of the feed probes 36, each conductive path 58 is an approximately straight electrically conductive pin 58 that extends a length from an end 60 to an opposite end 62. Optionally, the end 60 and/or the end 62 of each conductive pin 58 extends past the respective side 40 and 42 of the substrate body 38. Each conductive pin 58 may have any length. In alternative to the conductive pin 58, the conductive path 58 of each feed probe 36 may be defined by an electrical via (e.g., the plated electrical vias 658 shown in FIG. 11), such as, but not limited to, a plated electrical via, a filled electrical via, and/or the like.

Each hole 54 of the radiating patch 34 exposes the end 60 of the corresponding conductive pin 58 along the side 40 of the substrate body 38. In other words, the ends 60 of the conductive pins 58 are exposed along the side 40 of the substrate body 38 via the holes 54. Optionally, electrically conductive pads 64 are positioned on the side 40 of the substrate body 38. Each conductive pad 64 is positioned within a corresponding hole 54 and is electrically connected (e.g., engaged in physical contact with, soldered to, and/or the like) the end 60 of the corresponding conductive pin 58. As can be seen in FIGS. 2 and 3, the conductive pads 64 are spaced apart from the radiating patch 34 within the holes 54 by radial clearances 66 that extend between the conductive pads 64 and the radiating patch 34. Specifically, and referring now solely to FIG. 3 for clarity, each radial clearance 66 extends between a sidewall 68 of the corresponding conductive pad 64 and a sidewall 70 of the radiating patch 34 that defines the corresponding hole 54. The holes 54, conductive pads 64, and radial clearances 66 may each have any size overall and any size relative to each other.

Each hole 56 of the ground plane 16 exposes the end 62 of the corresponding conductive pin 58 along the side 42 of the substrate body 38. In other words, the ends 62 of the conductive pins 58 are exposed along the side 42 of the substrate body 38 via the holes 56. The exposure of the ends 62 along the side 42 enables the conductive pins 64 to be electrically connected to the feed network 12. The ends 62 of the conductive pins 58 are configured to be electrically connected to the feed network 12. In some embodiments, the ends 62 of the conductive pins 58 extend through the holes 56 of the ground plane 16 such that the ends 62 are exposed on a side 72 of the ground plane 16 for electrical connection to the feed network 12. In other embodiments, electrically conductive pads (not shown) are positioned within the holes 56 in electrical connection with (e.g., engaged in physical contact with, soldered to, and/or the like) the ends 62 of the conductive pins 58 in a substantially similar manner and configuration to the conductive pads 64 described above. The conductive pads that extend within the holes 56 can be electrically connected to the feed network 12 to electrically connect the conductive pins 58 to the feed network 12. In embodiments wherein conductive pads are positioned within the holes 56, the conductive pads may be spaced apart from the ground plane 16 within the holes 56 by radial clearances (not shown) that extend between the conductive pads and the ground plane 16. Other arrangements for electrically connecting the ends 62 of the conductive pins 58 to the feed network 12 may be used in other embodiments. The holes 56, any conductive pads, and any radial clearances may each have any size overall, any size relative to each other, and any shape. The ground plane 16 may include any number of the holes 56 for any number of conductive pins 58.

Referring again to FIGS. 2 and 3, although shown as having a cylindrical shape (i.e., a circular cross-sectional shape), each of the conductive pins 58 may include any other cross-sectional shape, such as, but not limited to, square, rectangular, oval, closed curves, shapes having more than four sides, and/or the like.

Figure 4:
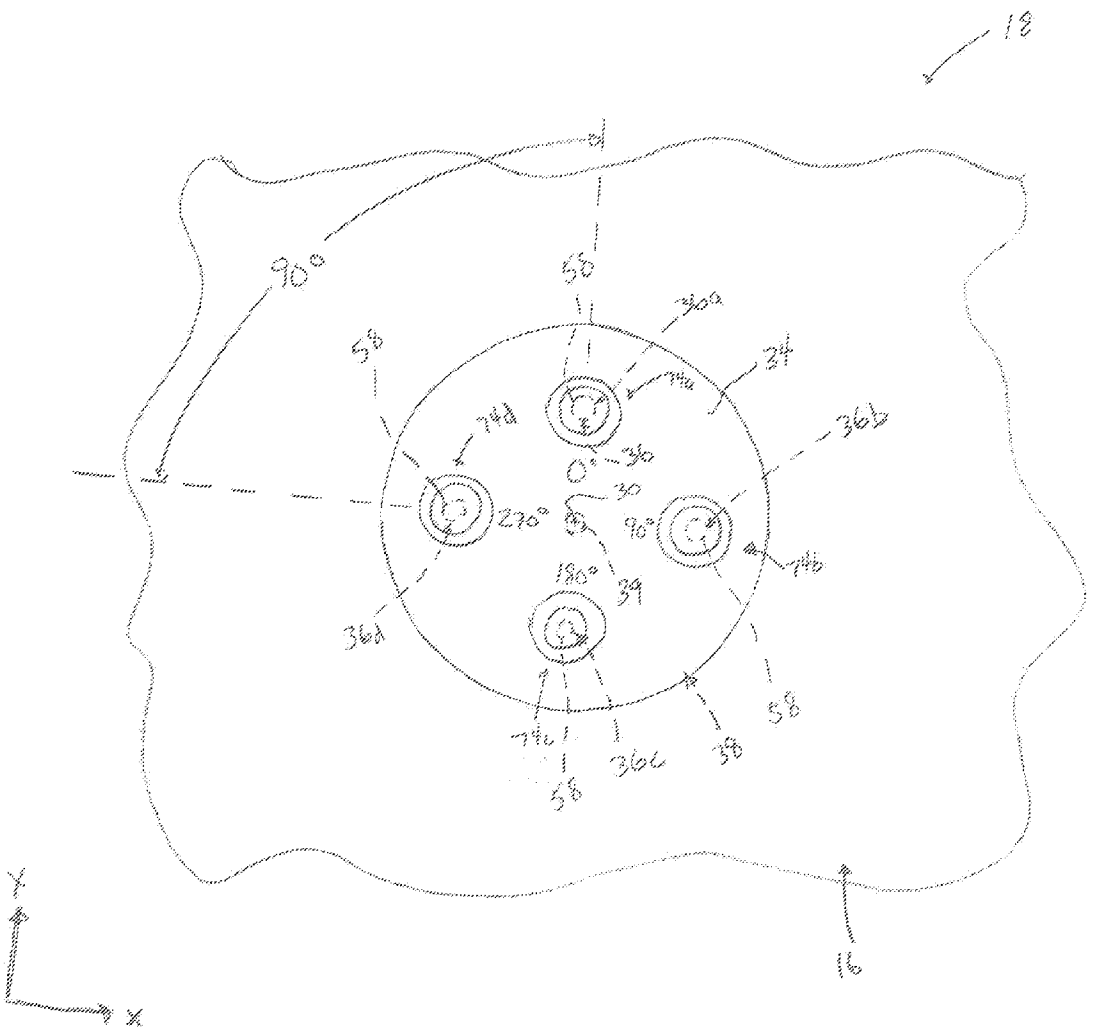
FIG. 4 is a plan view of the patch antenna shown in FIGS. 2 and 3.

FIG. 4 is a plan view of the patch antenna 18 shown in FIGS. 2 and 3. The conductive pins 58 of the feed probes 36 are electromagnetically coupled to the radiating patch 34 for generating a circularly polarized radiation pattern, which causes the patch antenna 18 to radiate circularly polarized electromagnetic waves. In addition to perfectly circular radiation patterns and electromagnetic waves, a "circularly polarized radiation pattern" and "circularly polarized electromagnetic waves", as used herein, each also include radiation patterns and electromagnetic waves, respectively, that do not have perfectly circular shapes, such as, but not limited to, elliptical shapes and/or the like. Moreover, the term "electromagnetically coupled" is intended to indicate that the conductive pins 58 of the feed probes 36 do not physically contact the radiating patch 34.

The exemplary embodiment of the patch antenna 18 includes four feed probes 36*a*, 36*b*, 36*c*, and 36*d* that are positioned relative to the substrate body 38 such that adjacent feed probes 36 are spaced apart from each other along the substrate body 38. The excitation phase and the angular orientation (i.e., the spacing pattern along the substrate body 38) of each of the four feed probes 36*a*, 36*b*, 36*c*, and 36*d* are selected to generate a circularly polarized radiation pattern. Specifically, the four feed probes 36*a*, 36*b*, 36*c*, and 36*d* feed the radiating patch 34 at four respective locations 74*a*, 74*b*, 74*c*, and 74*d* of approximately equal power amplitude, with each location being progressively delayed in phase (e.g., by approximately 90°). The feed network 12 (FIG. 1) may include one or more various components (not shown) for controlling the phase of each of the feed probes 36*a*, 36*b*, 36*c*, and 36*d*, such as, but not limited to, baluns, hybrid couplers, delay lines, and/or the like. For patch antennas of square or rectangular x-y cross sections, the relative spacing and phase delay of the four feed probes 36*a*, 36*b*, 36*c*, and 36*d* excites two different modes (e.g., orthogonal modes such as, but not limited to, $TM_{010}$ and $TM_{001}$) that are of approximately equal power amplitude but are delayed in phase with respect to each other. The different modes radiate separately and combine to generate electromagnetic fields that rotate in time, thereby generating circularly polarized electromagnetic waves. For patch antennas of circular x-y cross section, the relative spacing and phase delay of the four feed probes 36*a*, 36*b*, 36*c*, and 36*d* excite a single mode (e.g., modes such as, but not limited to, $TM_{110}$, $TM_{210}$, $TM_{310}$, or $TM_{410}$) with a circular field distribution. The rotation of the electromagnetic fields in time generates circularly polarized electromagnetic waves. Patch antennas of other x-y cross sections create rotating electromagnetic fields through exciting a combination of multiple modes.

The spacing along the substrate body 38 and the phase delay between the locations of adjacent feed probes 36 may be selected to configure the patch antenna 18 to operate at one or more predetermined modes. The patch antenna 18 may operate at any mode, such as, but not limited to, $TM_{110}$, $TM_{210}$, $TM_{310}$, and/or $TM_{410}$, and/or the like. In the exemplary embodiment of the patch antenna 18, circular polarization for the mode of $TM_{110}$ is achieved by spacing the feed probes 36 apart by approximately 90° along the substrate body 38 and controlling the phases of the feed probes 36 such that the feed probes 36 are configured to feed the radiating patch 34 with a progressive 90° phase shift. In other words, the feed probes 36 are spaced apart along the substrate body 38 with an approximate equal spacing from one another and the center of the radiating patch 34 such that adjacent feed probes 36 along the perimeter are delayed by a phase shift of approximately 90° with respect to each other. For example, as shown in FIG. 4, the feed probes 36*a*, 36*b*, 36*c*, and 36*d* have angular orientations of approximately 0°, approximately 90°, approximately 180°, and approximately 270°, respectively, and the feed probes 36*a*, 36*b*, 36*c*, and 36*d* have phases of approximately 0°, approximately 90°, approximately 180°, and approximately 270°, respectively.

Although the exemplary embodiment of the patch antenna 18 includes four feed probes 36*a*, 36*b*, 36*c*, and 36*d* to excite the radiating patch 34, it is contemplated that the patch antenna 18 could alternatively use only three feed probes 36 or a greater number of feed probes 36 than four. In embodiments wherein three or more than four feed probes 36 are used, the feed probes 36 may be spaced apart along the substrate body 38 with an approximate equal spacing from one another and the center of the radiating patch 34 such that adjacent feed probes 36 along the perimeter are delayed by a predetermined phase shift. Moreover, in addition to the conductive paths 58 of the feed probes 36, the patch antenna 18 may include one or more additional electrically conductive paths (e.g., an electrically conductive pin, a plated electrical via, a filled electrical via, and/or the like) positioned within the substrate body 38, for example the electrically conductive pin 39 shown in FIG. 4. The conductive pin 39 extends a length that extends along the central axis 30. Although shown as being aligned with the central axis 30 such that the conductive pin 39 is positioned at the center of the substrate body 38, the conductive pin 39 may be positioned at any other x-y location along the substrate body 38. Moreover, the conductive pin 39 may extend any length and may be positioned at any position along the thickness T (FIGS. 2 and 3) of the substrate body 38. In the exemplary embodiment of the conductive pin 39, the conductive pin 39 extends along an approximate entirety of the thickness T from the side 40 to the side 42. The conductive pin 39 have any orientation within the substrate body 38 relative to the central axis 30.

Figure 5:
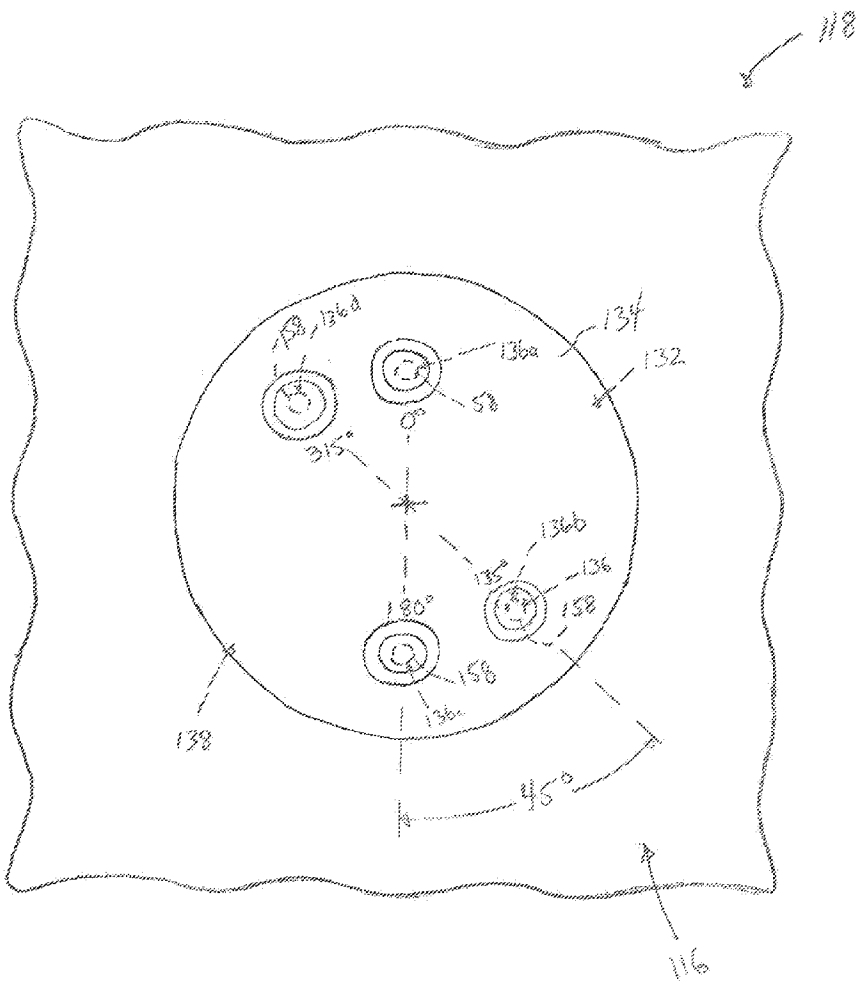
FIG. 5 is a plan view of another exemplary embodiment of a patch antenna.

Other spacing patterns of the conductive pins 58 of the feed probes 36 may be used in other embodiments. For example, FIG. 5 is a plan view of another exemplary embodiment of a patch antenna 118. The patch antenna 118 includes a dielectric substrate 132, a radiating patch 134 positioned on the substrate 132, and four feed probes 136 having conductive paths 158, namely feed probes 136*a*, 136*b*, 136*c*, and 136*d*. A ground plane 116 may or may not be considered a component of the patch antenna 118.

The four feed probes 136*a*, 136*b*, 136*c*, and 136*d* are positioned along a body 138 of the substrate 132 in a spaced apart relationship, as can be seen in FIG. 5. In the exemplary embodiment of the patch antenna 118, the spacing along the substrate body 138 and the phase delay between the feed probes 136 is selected to configure the patch antenna 118 to operate at the mode $TM_{210}$. Circular polarization for the mode of $TM_{210}$ is achieved by spacing the feed probes 136 apart along the substrate body 138 and controlling the phases of the feed probes 136 such that: the feed probes 136*a*, 136*b*, 136*c*, and 136*d* have angular orientations of approximately 0°, approximately 135°, approximately 180°, and approximately 315°, respectively; and the feed probes 136*a*, 136*b*, 136*c*, and 136*d* have phases of approximately 0°, approximately 90°, approximately 0°, and approximately 90°, respectively.

Figure 6:
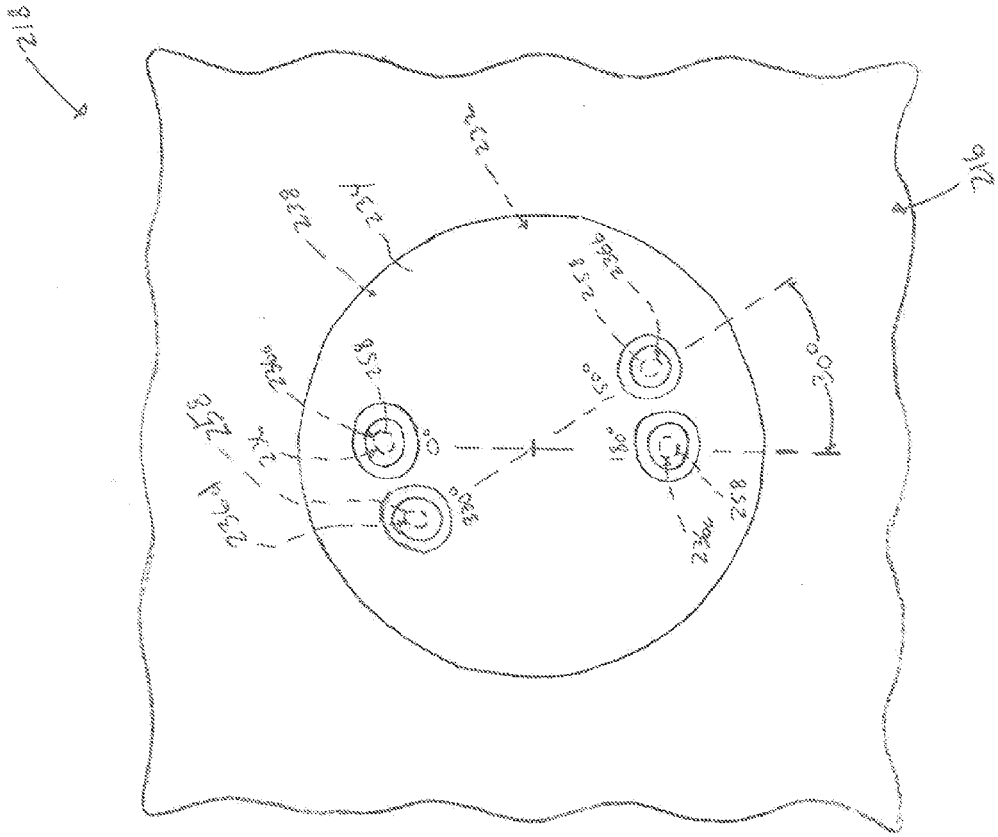
FIG. 6 is a plan view of another exemplary embodiment of a patch antenna.

Moreover, and for example, FIG. 6 is a plan view of another exemplary embodiment of a patch antenna 218 configured to operate in the mode $TM_{310}$. The patch antenna 218 includes a dielectric substrate 232, a radiating patch 234 positioned on the substrate 232, and four feed probes 236 having conductive paths 258. The four feed probes 236*a*, 236*b*, 236*c*, and 236*d* are positioned along a body 238 of the substrate 232 in a spaced apart relationship. The spacing along the substrate body 238 and the phase delay between the feed probes 236 is selected to configure the patch antenna 218 to operate at the mode $TM_{310}$. Circular polarization for the mode of $TM_{310}$ is achieved by spacing the feed probes 236 apart along the substrate body 238 and controlling the phases of the feed probes 236 such that: the feed probes 236*a*, 236*b*, 236*c*, and 236*d* have angular orientations of approximately 0°, approximately 150°, approximately 180°, and approximately 335°, respectively; and the feed probes 236*a*, 236*b*, 236*c*, and 236*d* have phases of approximately 0°, approximately 90°, approximately 180°, and approximately 270°, respectively. A ground plane 216 may or may not be considered a component of the patch antenna 218.

Figure 7:
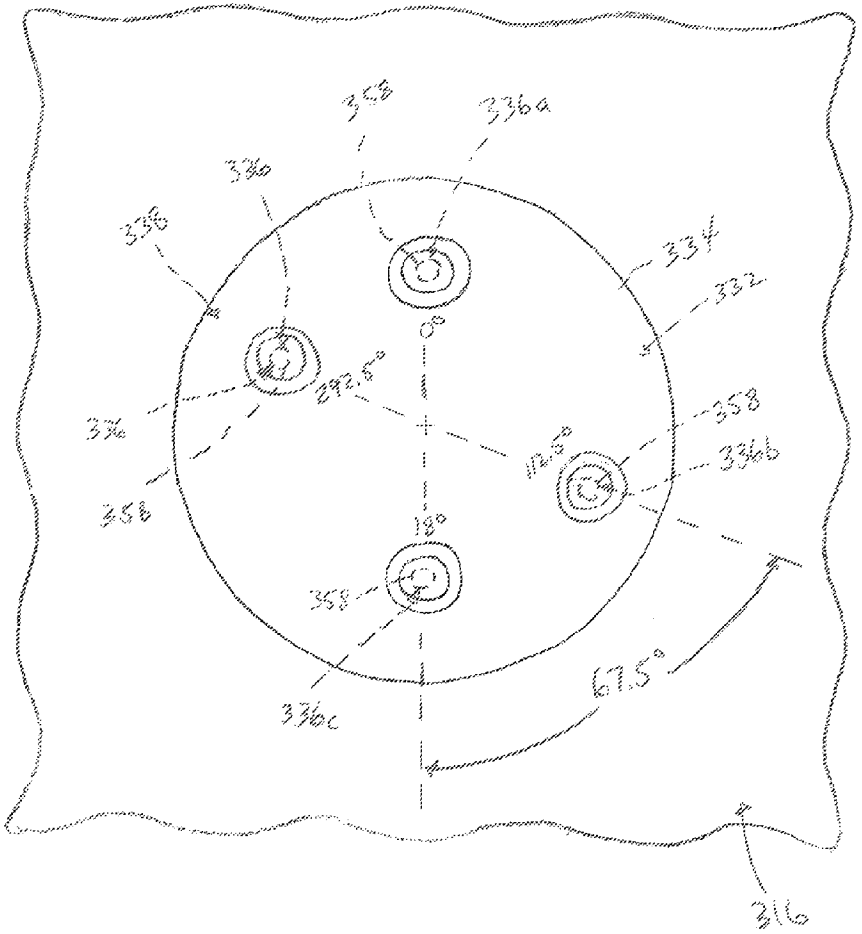
FIG. 7 is a plan view of another exemplary embodiment of a patch antenna.

FIG. 7 is a plan view of another exemplary embodiment of a patch antenna 318 configured to operate in the mode $TM_{410}$. The patch antenna 318 includes a dielectric substrate 332, a radiating patch 334 positioned on the substrate 332, and four feed probes 336 having conductive paths 358. The four feed probes 336*a*, 336*b*, 336*c*, and 336*d* are positioned along a body 338 of the substrate 332 in a spaced apart relationship. The spacing along the substrate body 338 and the phase delay between the feed probes 336 is selected to configure the patch antenna 318 to operate at the mode $TM_{410}$. Circular polarization for the mode of $TM_{410}$ is achieved by spacing the feed probes 336 apart along the perimeter 350 and controlling the phases of the feed probes 336 such that: the feed probes 336*a*, 336*b*, 336*c*, and 336*d* have angular orientations of approximately 0°, approximately 112.5°, approximately 180°, and approximately 292.5°, respectively; and the feed probes 236*a*, 236*b*, 236*c*, and 236*d* have phases of approximately 0°, approximately 90°, approximately 0°, and approximately 90°, respectively. A ground plane 316 may or may not be considered a component of the patch antenna 318.

Referring again to FIGS. 2 and 3 and the patch antenna 18, in operation, the patch antenna 18 transmits RF waves into the environment and/or receives RF waves from the environment. Specifically, the patch antenna 18 resembles a dielectric loaded cavity. The electric and magnetic fields within the patch antenna 18 can be found by treating the patch antenna 18 as a cavity resonator. The feed probes 36 may be configured to efficiently excite the desired cavity mode while suppressing undesirable cavity modes. The desired cavity mode of the patch antenna 18 is well excited when the feed probes 36 are relatively well coupled to the patch antenna 18 at the maxima of the desired mode's field distribution within the cavity. The feed probes 36 may provide a relatively efficient impedance match between the patch antenna 18 and the processing system 22 (FIG. 1). In addition, the feed probes 36 may be configured such that the input reactance of the feed probes 36 is minimized. Additional length of the conductive pins 58 increases feed probe inductance, while the size of any radial clearances (e.g., the radial clearances 66), the size of the holes 54, and/or the size of the holes 56 increases the capacitance of the feed probes 36. Adjusting the length of the conductive pins 58, the size of any radial clearances, the size of the holes 54, and/or the size of the holes 56 may enable the reactance of the feed probes 36 to be minimized, which may increase the performance of the patch antenna 18. "Performance" of the patch antenna 18 is intended to mean the ability of the patch antenna 18 to excite the desirable mode but still suppress any undesirable modes (e.g., higher-order modes).

The patch antenna 18 may operate at any frequencies. By "operate", it is meant that the patch antenna 18 is capable of transmitting and/or receiving RF waves at the particular frequencies. Examples of the operating frequencies of the patch antenna 18 include, but are not limited to, frequencies above approximately 0.50 GHz, frequencies above approximately 1.00 GHz, frequencies below approximately 3.00 GHz, frequencies below approximately 2.00 GHz, frequencies between approximately 1.00 GHz and 2.00 GHz, and/or the like. The patch antenna 18 may operate over a frequency band having any bandwidth. Examples of the bandwidth of the operational frequency band of the patch antenna 18 include, but are not limited to, approximately 100 MHz, approximately 400 MHz, approximately 500 MHz, approximately 600 MHz, and/or the like. The patch antenna 18 may have an increased bandwidth as compared to at least some known patch antennas. For example, some known patch antennas have a bandwidth of only approximately 5 MHz, while other known patch antennas may have a bandwidth of up to 24 MHz. The patch antenna 18 may have less bandwidth but more gain in the operating band than a similar patch antenna that includes L-shaped feed probes (not shown) that extend into the exterior surface 48 of the substrate body 38.

Various parameters of the patch antenna 18 may be selected to provide the patch antenna 18 with predetermined operating frequencies and/or with a predetermined bandwidth. For example, the diameter $DIA_1$ of the radiating patch 34, the diameter(s) DIA of the substrate body 38 (which may be variable or constant along the thickness T as is described above), the value of the thickness T of the substrate body 38, and/or the dielectric constant of the substrate body 38 may be selected to provide the patch antenna 18 with predetermined operating frequencies and/or with a predetermined bandwidth, for example to provide the increased bandwidth and/or reduced size relative to at least some known patch antennas. In some embodiments, the thickness T of the substrate body 38 is at least approximately 0.2 times the wavelength in the substrate 32. Substrate thicknesses T of the patch antenna 18 that are greater than approximately 0.05 wavelengths to approximately 0.7 wavelengths may facilitate increasing the bandwidth of the patch antenna 18 over the bandwidth of at least some known patch antennas 18. The bandwidth of the patch antenna 18 is inversely proportional to the square root of the dielectric constant of the substrate body 38, and directly proportional to the thickness T of the substrate body 38.

Moreover, various parameters of the feed probes 36 may be selected to provide the patch antenna 18 with predetermined operating frequencies and/or with a predetermined bandwidth. Examples of such various parameters of the feed probes 36 include, but are not limited to, the number of feed probes 36 used, the lengths of the conductive pins 58, the size (e.g., diameter) of the conductive pins 58, whether the conductive pins 58 engage the substrate body 38 within the thru openings 52, the amount of space between the conductive pins 58 and the substrate body 38 within the thru openings 52, and/or the like. As discussed above, the inclusion of four feed probes 36 (e.g., as compared to using only two feed probes 36) may facilitate providing the patch antenna 18 with a greater bandwidth than at least some known patch antennas 18. For example, in an antenna assembly 14 (FIG. 1), the inclusion of four feed probes 36 may reduce mutual coupling between patch antennas 18 a greater amount than including only two feed probes 36. Moreover, and for example, the inclusion of four feed probes 36 may suppress undesirable modes (e.g., higher-order modes), which may lead to an improvement in radiation purity.

The patch antenna 18 may have any size. For example, the overall x dimension of the patch antenna 18, the overall y dimension of the patch antenna 18, the diameter $DIA_1$ of the radiating patch 34 and the diameter(s) DIA of the substrate body 38 (which may be variable or constant along the thickness T as described above) may each have any value. Examples of the values of each of the overall x dimension of the patch antenna 18, the overall y dimension of the patch antenna 18, the diameter $DIA_1$ of the radiating patch 34, and the diameter(s) DIA of the substrate body 38 include, but are not limited to, less than approximately 102 mm (4.0 inches), less than approximately 76 mm (3.0 inches), less than approximately 51 mm (2.0 inches), between approximately 25 mm (1 inch) and approximately 76 mm (3.0 inches), between approximately 51 mm (2.0 inches) and approximately 102 mm (4.0 inches), between approximately 35.6 mm (1.4 inches) and approximately 40.6 mm (1.6 inches), and/or the like. It should be understood that the exemplary dimensions described herein of the diameters DIA and $DIA_1$ are applicable to any lengths and/or widths of the patch antenna 18 in embodiments wherein the patch antenna 18 has a cross-sectional shape along the x-y plane that is non-circular. The patch antenna 18 may be smaller than at least some known patch antennas. For example, at least some known patch antennas 18 have a width, length, and/or diameter that is at least 76 mm (3.0 inches).

Various parameters of the patch antenna 18 may be selected to provide the patch antenna 18 with a predetermined size, for example with predetermined values for the diameters DIA and $DIA_1$. For example, the dielectric constant of the substrate body 38 may be selected to provide the patch antenna 18 with the predetermined size, for example to provide the reduced size as compared to at least some known patch antennas. Generally, for a given resonant frequency of the patch antenna 18, the diameter $DIA_1$ of the radiating patch 34 is inversely proportional to the square root of the dielectric constant of the substrate body 38 such that as the dielectric constant is increased, the size of the patch antenna 18 is reduced. Moreover, the width, length, and/or diameter of the patch antenna 18 is approximately one half of a wavelength at the center of the frequency band. Accordingly, as the dielectric constant of the substrate body 38 is increased, the wavelength of the patch antenna 18 is reduced, thereby enabling the overall x and/or y dimensions (e.g., an overall length, an overall width, and/or an overall diameter) of the patch antenna 18 to be reduced. Generally, the bandwidth of a patch antenna is inversely related to the dielectric constant of the substrate of the patch antenna such that as the dielectric constant is increased, the bandwidth of the patch antenna is reduced. But, in the patch antenna 18, such a loss in bandwidth can be compensated for by increasing the thickness T of the substrate body 38.

Figures 8, 9:
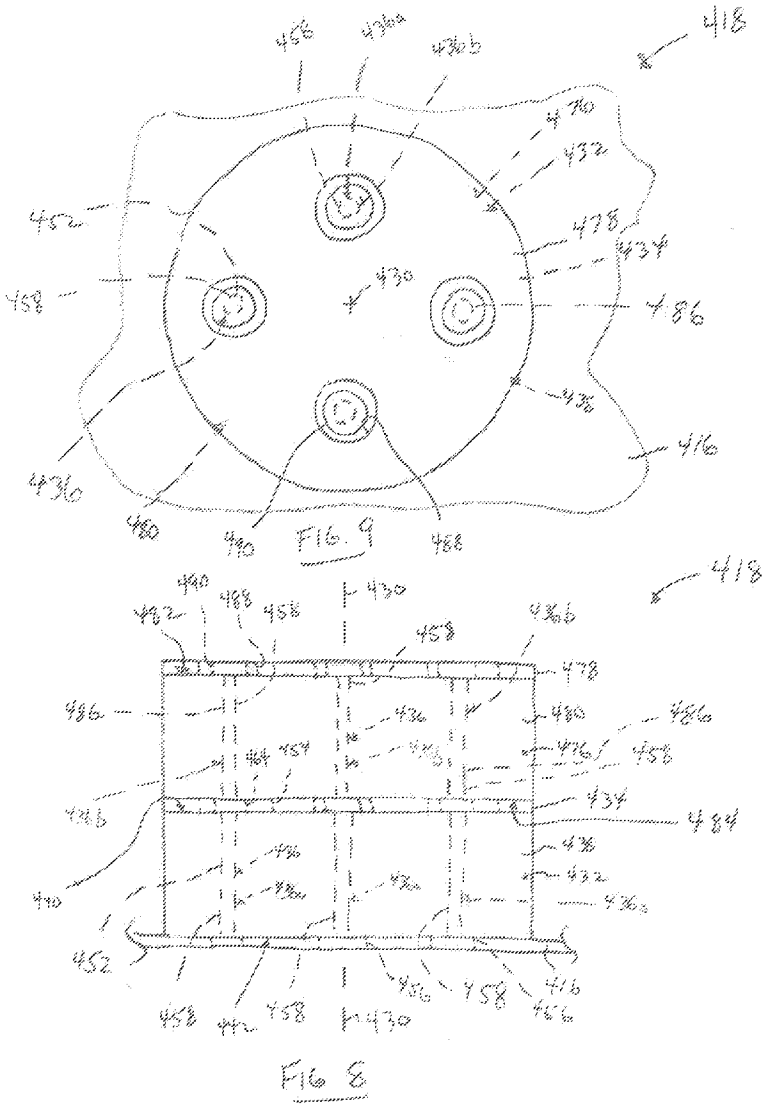
FIG. 8 is an elevational view of another exemplary embodiment of a patch antenna.
FIG. 9 is a plan view of the patch antenna shown in FIG. 8.

FIG. 8 is an elevational view of another exemplary embodiment of a patch antenna 418. FIG. 9 is a plan view of the patch antenna shown 418. The patch antenna 418 extends a height along a central axis 430 and includes two dielectric substrates 432 and 476, two radiating patches 434 and 478, and a plurality of feed probes 436. The substrate 432 is positioned on a ground plane 416. The radiating patch 434 positioned on the substrate 432. The substrate 476 is positioned on the radiating patch 434, and the radiating patch 478 is positioned on the substrate 476. The ground plane 416 may or may not be considered a component of the patch antenna 418. The substrate 432 may be referred to herein as a "first" substrate, while the substrate 476 may be referred to herein as a "second substrate". The radiating patch 434 may be referred to herein as a "first" radiating patch, while the radiating patch 478 may be referred to herein as a "second" radiating patch.

Each of the substrates 432 and 476 includes a respective body 438 and 480. The body 438 of the substrate 432 extends a thickness from a side 440 (not labeled in FIG. 9) of the body 438 to an opposite side 442 (not labeled in FIG. 9) of the body 438. The body 438 of the substrate 432 includes thru openings 452 that extend through the thickness of the body 438. Similarly, the body 480 of the substrate 476 extends a thickness from a side 482 (not labeled in FIG. 9) to an opposite side 484 (not labeled in FIG. 9) of the body 480. The body 480 of the substrate 476 includes thru openings 486 that extend through the thickness of the body 480. As can be seen in FIG. 8, the thru openings 452 of the substrate 432 are aligned with corresponding thru openings 486 of the substrate 476. The side 440 of the substrate body 438 may be referred to herein as a "first" side, while the side 442 may be referred to herein as a "second" side. The side 482 of the substrate body 480 may be referred to herein as a "first" side, while the side 484 may be referred to herein as a "second" side.

As best seen in FIG. 8, the ground plane 416 is positioned on the side 442 of the body 438 of the substrate 432, while the radiating patch 434 is positioned on the opposite side 440 of the substrate body 438. The body 480 of the substrate 476 is positioned on the radiating patch 434 such that the side 484 of the body 480 faces the radiating patch 434. The radiating patch 478 is positioned on the side 482 of the body 480 of the substrate 476.

The feed probes 436 include feed probes **436*a* that are configured to be electrically connected to the feed network 12 (FIG. 1) for exciting the radiating patch 434 and feed probes 436*b* that are configured to be electrically connected to the feed network 12 for exciting the radiating patch 478. In the exemplary embodiment of the feed probes 436*a*, each feed probe 436*a* includes an approximately straight conductive pin 458 that extends within a corresponding thru opening 452 of the substrate 432. Similarly, in the exemplary embodiment of the feed probes 436*b*, each feed probe 436*b* includes an approximately straight conductive pin 458 that extends within a corresponding thru opening 486 of the substrate 476. Although four are shown (only three are visible in FIG. 8), the patch antenna 418 may include any number of the feed probes 436*a* and any number of the feed probes 436*b***.

The ground plane 416 includes holes 456 that extend through the thickness of the ground plane 416. As can be seen in FIG. 8, each hole 456 of the ground plane 416 is aligned with a corresponding thru opening 452 of the substrate body 438. The radiating patch 434 includes holes 454 that extend through the thickness of the radiating patch 434. Each hole 454 of the radiating patch 434 is aligned with a corresponding thru opening 452 of the substrate body 438 and with a corresponding thru opening 486 of the substrate body 480. The radiating patch 478 includes holes 488 that extend through the thickness of the radiating patch 478. Each hole 488 is aligned with a corresponding thru opening 486 of the substrate body 480. The holes 454 may be referred to herein as "first" holes, while the holes 488 may be referred to herein as "second" holes.

Optionally, electrically conductive pads 464 are positioned within the holes 454 of the radiating patch 434 and/or electrically conductive pads 490 are positioned within the holes 488 of the radiating patch 478. Each conductive pad 464 is electrically connected (e.g., engaged in physical contact with, soldered to, and/or the like) to the conductive pin 458 of the corresponding feed probe **436*a* and the conductive pin 458 of the corresponding feed probe 436*b*. The conductive pads 464 thereby electrically connect the conductive pins 458 of the feed probes 436*a* to the conductive pins 458 of the corresponding feed probes 436*b*. Each conductive pad 490 is electrically connected (e.g., engaged in physical contact with, soldered to, and/or the like) to the conductive pin 458 of the corresponding feed probe 436*b*. In the exemplary embodiment of the patch antenna 418, the conductive pins 458 and the conductive pads 490 and 464 define electrical paths that extend along an approximate entirety of the height of the patch antenna 418. In other embodiments, the patch antenna 418 does not include the conductive pads 490 and/or the conductive pads 464 and the electrical paths that extend along the approximate entirety of the height of the patch antenna 418 are defined solely by: (1) the conducive pins 458; (2) the conductive pins 458 and the conductive pads 464; or (3) the conductive pins 458 and the conductive pads 490. For example, a single conductive pin 458 may extend within both a thru opening 452 of the substrate 432 and the corresponding (i.e., aligned) thru opening 486 of the substrate 476. In alternative to a single conductive pin 458 that extends within corresponding thru openings 452 and 486, discrete conductive pins 458 of corresponding thru openings 452 and 486 may abut in physical contact with each other. Moreover, and for example, a single electrical via (e.g., a plated electrical via, a filled electrical via, and/or the like) may extend within both a thru opening 452 of the substrate 432 and the corresponding thru opening 486 of the substrate 476 in alternative to a single conductive pin 458 that extends within corresponding thru openings 452 and 486**.

Each of the radiating patches 434 and 478 may operate at any frequencies. In some embodiments, the radiating patches 434 and 478 operate at different frequency ranges, which may or may not overlap.

Although shown and described as being "thru" openings 486 that extend through the thickness of the body 480 of the substrate 476, alternatively the openings 486 do not extend all the way through the thickness of the substrate body 480. Specifically, the openings 486 do not extend through the side 482 of the substrate body 480 in such alternative embodiments such that the corresponding end (i.e., the proximate end) of the corresponding conductive pin 458 is spaced apart from the side 482 in a direction toward the side 484 by material of the substrate body 480.

Although two of each are shown, the patch antenna 418 may include any number of dielectric substrates and any number of radiating patches, whether or not the number of radiating patches is the same as the number of substrates.

Figure 10:
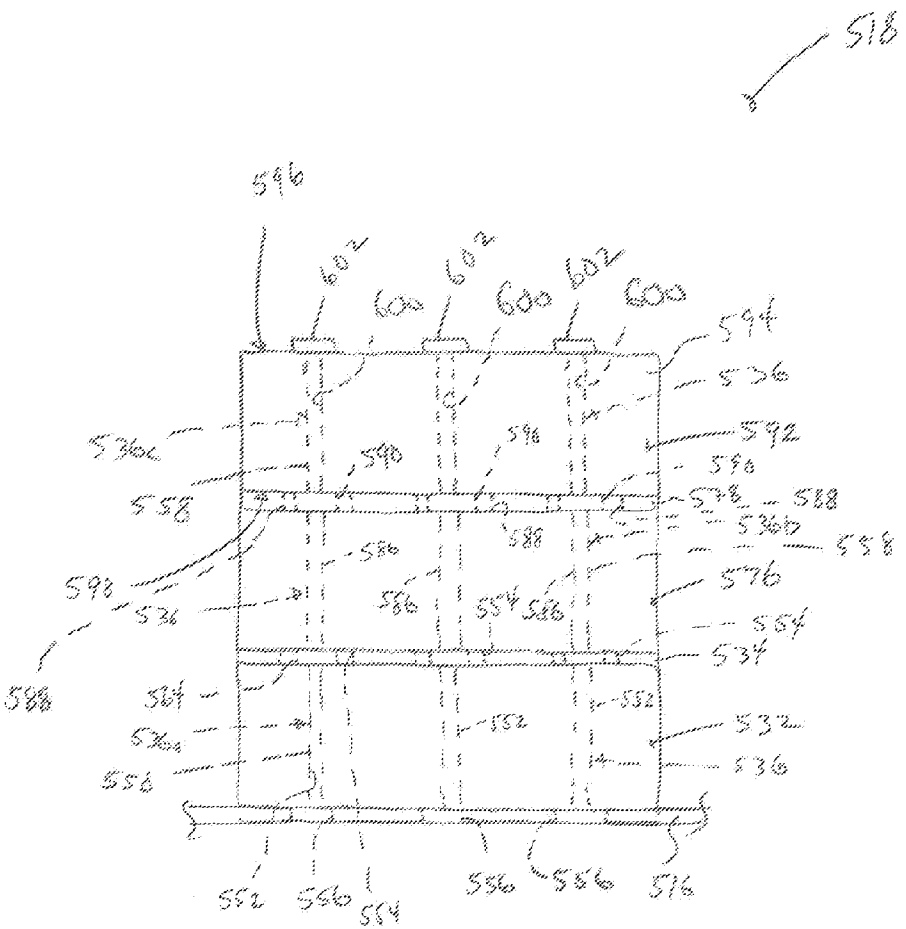
FIG. 10 is an elevational view of another exemplary embodiment of a patch antenna.

FIG. 10 is an elevational view of another exemplary embodiment of a patch antenna 518. The patch antenna 518 is similar to the patch antenna 418 shown in FIGS. 8 and 9. For example, the patch antenna 518 includes two dielectric substrates 532 and 576, two radiating patches 534 and 578, and a plurality of feed probes 536*a*, 536*b*, and 536*c* that include approximately straight conductive pins 558. The substrate 532 is positioned on a ground plane 516. The radiating patch 534 positioned on the substrate 532. The substrate 576 is positioned on the radiating patch 534, and the radiating patch 578 is positioned on the substrate 576. But, the patch antenna 518 also includes another dielectric substrate 592 that is positioned on the radiating patch 578. The ground plane 516 may or may not be considered a component of the patch antenna 518. The substrate 532 may be referred to herein as a "first" substrate, the substrate 576 may be referred to herein as a "second" substrate, and the substrate 592 may be referred to herein as a "third" substrate. The radiating patch 534 may be referred to herein as a "first" radiating patch, while the radiating patch 578 may be referred to herein as a "second" radiating patch.

The substrate 592 includes body 594 that extends a thickness from a side 596 of the body 594 to an opposite side 598 of the body 594. The substrate 592 is positioned on the radiating patch 578 such that the side 598 of the substrate body 594 faces the radiating patch 578. The body 594 of the substrate 592 includes thru openings 600 that extend through the thickness of the body 594. The thru openings 600 are aligned with corresponding thru openings 586 of the substrate 576. The side 596 of the substrate body 594 may be referred to herein as a "first" side, while the side 598 may be referred to herein as a "second" side.

The ground plane 516 includes holes 556 that extend through the thickness of the ground plane 516. Each hole 556 of the ground plane 516 is aligned with a corresponding thru opening 552 of the substrate 532. The radiating patch 534 includes holes 554 that extend through the thickness of the radiating patch 534. Each hole 554 of the radiating patch 534 is aligned with a corresponding thru opening 552 of the substrate 532 and with a corresponding thru opening 586 of the substrate 576. The radiating patch 578 includes holes 588 that extend through the thickness of the radiating patch 578. Each hole 588 is aligned with a corresponding thru opening 586 of the substrate 576 and with a corresponding thru opening 600 of the substrate body 594. The holes 554 may be referred to herein as "first" holes, while the holes 588 may be referred to herein as "second" holes. The holes 556 of the ground plane 516 may be referred to herein as "third" holes.

The conductive pins 558 of the feed probes 536*c* extend within corresponding thru openings 600 of the substrate 592 and are electrically connected to optional electrically conductive pads 590 that are positioned on the substrate 576 within the radiating patch 578. Optionally, electrically conductive pads 602 are positioned on the side 596 of the substrate body 594 in electrical connection with the conductive pins 558 of the corresponding feed probes 536*c*. As shown in FIG. 10, the exemplary embodiment of the patch antenna 518 includes optional electrically conductive pads 564 that are positioned on the substrate 532 within the radiating patch 534. The patch antenna 518 may include any number of the feed probes 536*a*, any number of the feed probes 536*b*, and any number of the feed probes 536*c*.

In the exemplary embodiment of the patch antenna 518, the conductive pins 558 and the conductive pads 564, 590, and 602 define electrical paths that extend along an approximate entirety of the height of the patch antenna 518. In other embodiments, the patch antenna 518 does not include the conductive pads 564, the conductive pads 590, and/or the conductive pads 602 and the electrical paths that extend along the approximate entirety of the height of the patch antenna 518 are defined solely by: (1) the conducive pins 558; (2) the conductive pins 558 and the conductive pads 564; (3) the conductive pins 558 and the conductive pads 590; or (4) the conductive pins 558 and the conductive pads 602. For example, a single conductive pin 558 may extend within a thru opening 552 of the substrate 432, within the corresponding (i.e., aligned) thru opening 586 of the substrate 476, and within the corresponding thru opening 600 of the substrate 592. In alternative to a single conductive pin 558 that extends within corresponding thru openings 552, 586, and 600, discrete conductive pins 558 of corresponding thru openings 552, 586, and 600 may abut in physical contact with each other. Moreover, and for example, a single electrical via (e.g., a plated electrical via, a filled electrical via, and/or the like) may extend within a thru opening 552 of the substrate 532, within the corresponding thru opening 586 of the substrate 576, and within the corresponding thru opening 600 of the substrate 592.

Although shown and described as being "thru" openings 586 that extend through the thickness of a body of the substrate 576, alternatively the openings 586 do not extend all the way through the thickness of the body of the substrate 576. Specifically, the openings 586 do not extend through the side of the substrate 576 on which the radiating patch 578 is positioned in such alternative embodiments, such that the corresponding end (i.e., the proximate end) of the corresponding conductive pin 558 of the corresponding feed probe 536*b* is spaced apart from the side on which the radiating patch 578 is positioned by material of the body of the substrate 576. Moreover, in embodiments wherein the openings 586 are thru openings 586 that do extend through the thickness of the body of the substrate 576, the thru openings 600 of the body 594 of the substrate 592 may not extend all the way through the thickness of the substrate body 594. Specifically, the openings 600 may not extend through the side 596 of the substrate body 594 such that the corresponding end (i.e., the proximate end) of the corresponding conductive pin 558 of the corresponding feed probe 536*c* is spaced apart from the side 596 of the substrate body 594 in a direction toward the side 598 by material of the substrate body 594.

Although three substrates 536, 576, and 592 and two radiating patches 534 and 578 are shown, the patch antenna 518 may include any number of dielectric substrates and any number of radiating patches, whether or not the number of radiating patches is the same as the number of substrates. For example, a radiating patch (not shown) may be positioned on the side 596 of the body 594 of the substrate 592.

Figure 11:
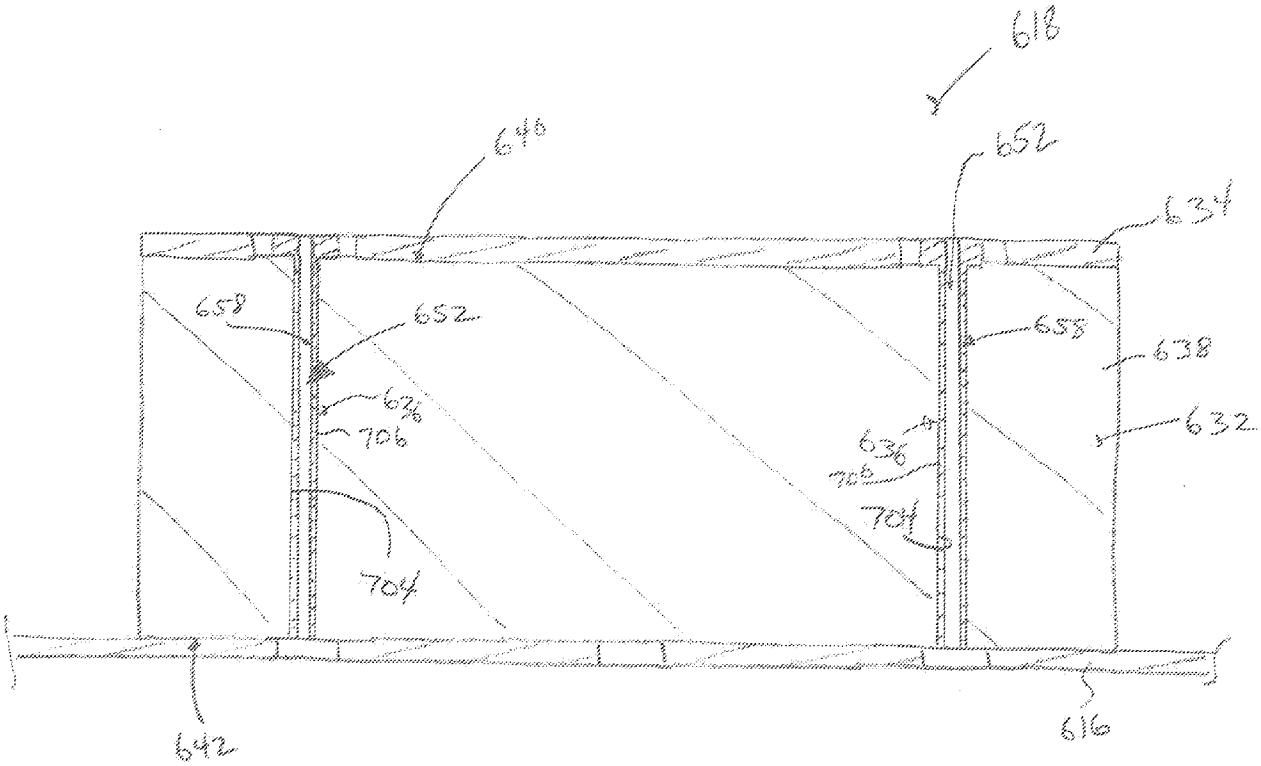
FIG. 11 is an elevational view of yet another exemplary embodiment of a patch antenna.

FIG. 11 is a cross-sectional view of yet another exemplary embodiment of a patch antenna 618 illustrating another exemplary embodiment of the feed probes 36 (FIGS. 2-4). The patch antenna 618 includes a dielectric substrate 632, a radiating patch 634 positioned on the substrate 632, and a plurality of feed probes 636. The ground plane 616 shown in FIG. 11 may or may not be considered a component of the patch antenna 618.

The substrate 632 of the patch antenna 618 has a body 638 that extends a thickness along a central axis 630 from a side 640 of the substrate body 638 to an opposite side 642 of the substrate body 638. The substrate body 638 includes thru openings 652 that extend through the thickness of the body 638. But, instead of the conductive pins 58 (FIGS. 2-4), the feed probes 636 include electrical vias 658 that are formed within the thru openings 652. Specifically, one or more interior walls 704 of each thru opening 652 is plated and/or otherwise formed with an electrically conductive material 706 to form the corresponding electrical via 658. The electrical vias 658 define electrically conductive paths that extend within the thru openings 652. The patch antenna 518 may include any number of the feed probes 636. Each electrical via 658 may be referred to herein as a "conductive path".

The embodiments described and/or illustrated herein may provide a patch antenna that operates over a wider frequency band than at least some known patch antennas. The embodiments described and/or illustrated herein may provide a patch antenna having a frequency band that overlaps the different frequency bands of two or more different GNSS satellite constellations. The embodiments described and/or illustrated herein may provide a patch antenna that is capable of communicating with two or more different GNSS satellite constellations that operate over different frequency bands. The embodiments described and/or illustrated herein may provide a patch antenna that operates in a plurality of different frequency sub-bands of the frequency band of a particular GNSS satellite constellation. In other words, the embodiments described and/or illustrated herein may provide a patch antenna having coverage over multiple frequency bands for a single satellite constellation.

The embodiments described and/or illustrated herein may provide a patch antenna that is smaller than at least some known patch antennas. For example, the embodiments described and/or illustrated herein may provide a patch antenna that includes a smaller width, length, diameter, radius, and/or the like than at least some known patch antennas. The embodiments described and/or illustrated herein may provide an array that is capable of including more patch antennas than at least some known arrays of patch antennas.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A patch antenna, comprising:

a dielectric substrate having a body that extends a thickness from a first side to a second side that is opposite the first side, the body of the substrate comprising thru openings that extend through the thickness of the body;

a radiating patch positioned on the first side of the body of the substrate, the radiating patch comprising holes that are aligned with corresponding thru openings of the body of the substrate;

a ground plane positioned on the second side of the body of the substrate;

at least three feed probes electromagnetically coupled to the radiating patch such that the patch antenna is configured to generate a circularly polarized radiation pattern, each feed probe comprising a conductive path that extends within a corresponding thru opening of the body of the substrate from the second side of the body to the first side of the body, each conductive path being exposed along the first side of the body via the holes of the radiating patch, the feed probes being positioned relative to the body of the substrate such that adjacent feed probes are spaced apart from each other along the body, the feed probes being configured to feed the radiating patch at at least three points with approximately equal power amplitude; and conductive pads positioned on the first side of the body of the substrate, the radiating patch comprising holes that are aligned with corresponding thru openings of the body, the conductive pads being positioned within corresponding holes such that the conductive pads are electrically connected to corresponding conductive paths, the conductive pads being spaced apart from the radiating patch within the holes by radial clearances that extend between the conductive pads and the radiating patches.

2. The antenna of claim 1, wherein the conductive paths are defined by conductive pins.

3. The antenna of claim 1, wherein the conductive paths are defined by electrical vias.

4. The antenna of claim 1, wherein the ground plane comprises holes that are aligned with corresponding thru openings of the body of the substrate, ends of the conductive paths being exposed along the second side of the body via the holes.

5. The antenna of claim 1, wherein the patch antenna includes four feed probes, adjacent feed probes being spaced apart from each other along the body of the substrate by approximately 90°, the feed probes being configured to feed the radiating patch with a progressive 90° phase shift.

6. The antenna of claim 1, wherein the body of the substrate has a dielectric constant that is greater than approximately 6.0.

7. The antenna of claim 1, wherein the radiating patch is configured to at least one of receive or transmit radio frequency (RF) energy over a bandwidth of at least approximately 100 MHz.

8. The antenna of claim 1, wherein the antenna has a width of less than approximately 2.0 inches (50.8 mm).

9. A patch antenna comprising:

at least first and second dielectric substrates each having a body that extends a thickness from a first side to a second side that is opposite the first side, the body of each of the at least first and second substrates comprising openings that extend along the thickness of the body;

a ground plane positioned on the second side of the body of the first substrate;

a first radiating patch positioned on the first side of the body of the first substrate, the body of the second substrate being positioned on the first radiating patch such that the second side of the body of the second substrate faces the first radiating patch, the first radiating patch comprising first holes that are aligned with corresponding openings of the body of the first substrate;

a second radiating patch positioned on the first side of the body of the second substrate, the second radiating patch comprising second holes that are aligned with corresponding openings of the body of the second substrate;

at least three feed probes electromagnetically coupled to the first and second radiating patches such that the antenna is configured to generate a circularly polarized radiation pattern, each feed probe comprising a conductive path that extends within a corresponding opening of the body of at least one of the first or second substrates, the feed probes being configured to feed the first and second radiating patches at at least three points with approximately equal power amplitude; and first conductive pads positioned on the first side of the body of the first substrate and second conductive pads positioned on the first side of the body of the second substrate, the first and second conductive pads being positioned within the first and second holes, respectively, such that the first and second conductive pads are electrically connected to corresponding conductive paths, the first and second conductive pads being spaced apart from the first and second radiating patches, respectively, within the first and second holes, respectively, by radial clearances.

10. The antenna of claim 9, wherein the first and second radiating patches operate at the same or different frequency bands.

11. The antenna of claim 9, wherein the ground plane comprises third holes that are aligned with corresponding openings of the body of the first substrate, and the conductive paths are exposed along the second side of the body of the first substrate via the third holes.

12. The antenna of claim 9, wherein the feed probes are configured to feed the first and second radiating patches with a progressive 90° phase shift.

13. The antenna of claim 9, wherein the first and second radiating patches are each configured to at least one of receive or transmit radio frequency (RF) energy over a bandwidth of at least approximately 100 MHz.

14. The antenna of claim 9, wherein the antenna has a width of less than approximately 2.0 inches (50.8 mm).

15. The antenna of claim 9, wherein each conductive path of the feed probes comprises a conductive pin or an electrical via that extends continuously from the second side of the body of the first substrate to the first side of the body of the second substrate.

16. A patch antenna comprising:

at least first, second, and third dielectric substrates each having a body that extends a thickness from a first side to a second side that is opposite the first side, the body of at least the first and second substrates of the at least first, second, and third substrates comprising openings that extend along the thickness of the body;

a ground plane positioned on the second side of the body of the first substrate;

a first radiating patch positioned on the first side of the body of the first substrate, the body of the second substrate being positioned on the first radiating patch such that the second side of the body of the second substrate faces the first radiating patch, the first radiating patch comprising first holes that are aligned with corresponding openings of the body of the first substrate;

a second radiating patch positioned on the first side of the body of the second substrate, the body of the third substrate being positioned on the second radiating patch such that the second side of the body of the third substrate faces the second radiating patch, the second radiating patch comprising second holes that are aligned with corresponding openings of the body of the second substrate;

at least three feed probes electromagnetically coupled to the first and second radiating patches such that the antenna is configured to generate a circularly polarized radiation pattern, each feed probe comprising a conductive path that extends within a corresponding opening of the body of at least one of the first, second, or third substrates, the feed probes being configured to feed the first and second radiating patches at at least three points with approximately equal power amplitude; and conductive pads positioned on the first side of the body of at least one of the first substrate, the second substrate, or the third substrate, the conductive pads being electrically connected to at least one corresponding conductive path.

17. The antenna of claim 16, wherein each conductive path of the feed probes comprises a conductive pin or an electrical via that extends continuously from the second side of the body of the first substrate to the first side of the body of the third substrate.

* * * * *